United States Patent [19]

Ono et al.

[11] Patent Number: 4,847,187

[45] Date of Patent: Jul. 11, 1989

[54] LIGHT-SENSITIVE SILVER HALIDE PHOTOGRAPHIC MATERIAL

[75] Inventors: Kouzi Ono; Mikio Kawasaki, both of Hino, Japan

[73] Assignee: Konishiroku Photo Industry Co., Ltd., Tokyo, Japan

[21] Appl. No.: 90,504

[22] Filed: Aug. 28, 1987

[30] Foreign Application Priority Data

Sep. 12, 1986 [JP] Japan ..... 61-216875

[51] Int. Cl.[4] ..... G03C 1/82; G03C 1/10

[52] U.S. Cl. ..... 430/528; 430/529; 430/607; 430/636

[58] Field of Search ..... 430/528, 529, 607, 636

[56] References Cited

U.S. PATENT DOCUMENTS

| | | | |
|---|---|---|---|
| 2,996,382 | 8/1961 | Luckey et al. | 430/567 |
| 3,178,282 | 4/1965 | Luckey et al. | 430/567 |
| 3,708,300 | 1/1973 | Luckey et al. | 430/528 |
| 3,754,924 | 8/1973 | De Geest et al. | 430/636 |
| 3,929,486 | 12/1975 | Habu et al. | 430/607 |
| 4,272,616 | 6/1981 | Kishimoto | 430/637 |
| 4,615,970 | 10/1986 | Kojima et al. | 430/614 |
| 4,626,498 | 12/1986 | Shuto et al. | 430/567 |

*Primary Examiner*—Richard L. Schilling

*Attorney, Agent, or Firm*—Frishauf, Holtz, Goodman & Woodward

[57] ABSTRACT

Disclosed is a light-sensitive silver halide photographic material comprising at least one silver halide emulsion layer on at least one side of a support and at least auxiliary layer adjacent to the silver halide emulsion layer, the silver halide emulsion layer containing a surface latent type silver halide emulsion and a silver halide emulsion having fog internally of the grains, and the auxiliary layer containing a compound represented by the formula (I) shown below:

$$RfSO_3M \qquad \text{Formula (I)}$$

wherein Rf is a substituted or unsubstituted alkyl group or a substituted or unsubstituted aralkyl group, containing at least 3 fluorine atoms, and M represents hydrogen atom, an alkali metal or ammonium group.

According to the present invention, a light-sensitive silver halide photographic material improved in antistatic performance and also improved in storability without accomplaniment of lowering in sensitivity, which can give images with sensitivity, high contrast as well as high covering power is provided.

13 Claims, No Drawings

LIGHT-SENSITIVE SILVER HALIDE PHOTOGRAPHIC MATERIAL

BACKGROUND OF THE INVENTION

This invention relates to a light-sensitive silver halide photographic material, more particularly to a light-sensitive silver halide photographic material improved in antistatic performance and also improved in storability without accompaniment of lowering in sensitivity, which can give images with high sensitivity, high contrast as well as high covering power.

Metallic silver which is indispensable as the starting material for the light-sensitive silver halide photographic material is reducing its supply, while it is demanded in various industrial fields, and attempts of silver saving in light-sensitive silver halide photographic materials have been actively done.

Also, with respect to performances of the light-sensitive silver halide photographic material, various requirements have been made, and particularly in a high sensitivity light-sensitive silver halide photographic material with stable photographic performances has been sought after. Particularly, in light-sensitive materials for X-ray, for alleviating the X-ray exposure dose to human bodies, those with higher sensitivity have been demanded, and yet light-sensitive photographic materials of high image quality have been sought after.

As a method to obtain high sensitivity and yet effect silver saving, U.S. Pat. Nos. 2,996,382 and 3,178,282 disclose the method in which a photographic image with high sensitivity, high contrast and high covering power is obtained by using a light-sensitive silver halide photographic material having surface latent image type silver halide grains and fine silver halide grains, having fogged nuclei internally of the grains, exsited adjacent to each other.

However, this method was poor in storability, particularly storability under high temperature, high humidity conditions, thus having the drawbacks that increased fog and lowering in sensitivity will occur.

On the other hand, since light-sensitive photographic materials generally comprise a support having electrical insulation and photogrpahic layers, static charges will be frequently accumulated by receiving contact friction or peeling between the same kind or different kinds of materials during production steps and usage of light-sensitive photographic materials. The static charges accumulated will cause many troubles, and the most crucial obstacle is discharging of the accumulated static charges before development processing which results in exposure of the light-sensitive emulsion layer to form dot-like spots or dentrite-like or feather-like line splotches when subjected to development processing. This is the so-called static mark, which will remarkably impair or sometimes lose entirely the commercial value of a photographic film.

For example, when said static mark appears in an X-ray film for medical or industrial use, it may lead to a very dangerous judgement. Also, when it appears in a color film, microfilm, etc., it may lead to defect of an image information.

As techniques for improvement of antistatic property of films, there have been known a large number of techniques in the art such as use of a compound obtained by addition copolymerization of glycidol and ethylene oxide with a phenol-aldehyde condensate as disclosed in Japanese Unexamined Patent Publication No. 56220/1976, combinations of a lanolin type ethylene oxide adduct and an alkali metal salt and/or an alkaline earth metal as disclosed in Japanese Unexamined Patent Publication No. 145022/1978, a water-soluble inorganic chloride and a matte agent (Japanese Patent Application No. 69242/1979), etc. However, many of these techniques which can improve antistatic characteristic will have rather deleterious effects on storability.

On the other hand, when antistatic agent conventionally used in the prior art are used, storability does not change, or may be rather worsened.

For improvement of storability, many heterocyclic compounds, typically 4-hydroxy-6-methyl-1,3,3a,7-tetrazaindene, 3-methyl-benzothiazole, 1-phenyl-5-mercaptotetrazole, many compounds such as hydrous silver compounds, mercapto compounds, metal salts, etc. have been known, but all of them had the drawback of accompaniment of lowering in sensitivity.

SUMMARY OF THE INVENTION

An object of the present invention is to provide a light-sensitive silver halide photographic material improved in antistatic performance and also improved in storability without accompaniment of lowering in sensitivity, which can give an image with high sensitivity, high contrast and high covering power.

The light-sensitive silver halide photographic material comprises at least one silver halide emulsion layer on at least one side of a support and at least auxiliary layer adjacent to said silver halide emulsion layer, said silver halide emulsion layer containing a surface latent type silver halide emulsion and a silver halide emulsion having fog internally of the grains, and said auxiliary layer containing a compound represented by the formula (I) shown below:

$$RfSO_3M \qquad \text{Formula (I)}$$

wherein Rf is a substituted or unsubstituted alkyl group or a substituted or unsubstituted aralkyl group, containing at least 3 fluorine atoms, and M represents hydrogen atom, an alkali metal or ammonium group.

The above object can be accomplished by the silver halide silver emulsion containing a surface latent image type silver halide emulsion and an emulsion having fog internally of the grains and incorporation of the compound represented by the formula (I) in the auxiliary layer.

Further, by using a nonionic ethylene oxide compound in combination, sensitivity increase and improvement of antistatic performance can be effected without worsening storability.

DETAILED DESCRIPTION OF THE INVENTION

In the present invention, the auxiliary layer refers to a photographic constituting layer other than silver halide emulsion layer (e.g. backing layer, halation preventive layer, intermediate layer, protective layer, filter layer, subbing layer, etc.) and it may sometimes express a hydrophilic colloid layer other than sliver halide emulsion layer in the present specification.

Specific examples of the compound represented by the formula (I) are shown below, but the compounds available in the present invention are not limited to these specific examples.

[Exemplary compounds]

$CF_3(CF_2)_7-SO_2-N(C_2H_5)-CH_2-SO_3H$ (I-1)

$CF_3(CF_2)_8-CO-N(C_2H_5)-(CH_2)_2-SO_3K$ (I-2)

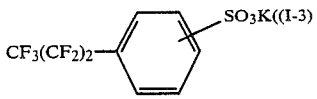

(—$SO_3K$ is attached on o-, m- or p-position)

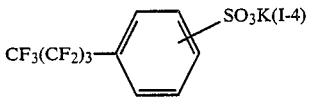

(—$SO_3K$ is attached on o-, m- or p-position)

$CF_3(CF_2)_7SO_3K$ (I-5)

$CF_3(CF_2)_6-COO-(CH_2)_3-SO_3K$ (I-6)

$H(CF_2)_6-CH_2-O-(CH_2)_3-SO_3K$ (I-7)

$H(CF_2)_6CH_2OC(=O)-CH_2$ (I-8)
$H(CF_2)_8CH_2OC(=O)-CH-SO_3Na$ $C_{16}H_{33}-CH(SO_3Na)-COOCH_2CF_3$ (I-9)

$CF_3-(CF_2)_7-SO_2-N(CH_3)-CH_2CH_2SO_3Na$ (I-10)

$CF_3-C(C_2F_5)(C_2F_5)-CH(CF_3)-CF(CF_3)-SO_3Na$ (I-11)

$H(CF_2)_6CH_2OCH_2CH(OH)CH_2SO_3K$ (I-12)

$H(CF_2)_4CH_2OCH_2CH(OH)CH_2-N(CH_3)-SO_3Na$ (I-13)

$H(CF_2)_8CH_2OCH_2CH(OH)CH_2-N(CH_3)-CH_2CH_2SO_3Na$ (I-14)

$(CF_3)_2CH-O-(CH_2)_3SO_3Na$ (I-15)

$H(CF_2)_8CH_2O(CH_2)_3SO_3Na$ (I-16)

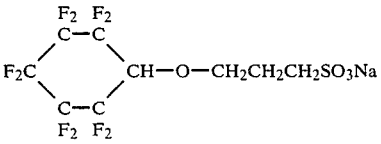

(I-17)

$F_3C-C(C_2H_5)_2-O-CH_2CH_2CH_2SO_3Na$ (I-18)

-continued

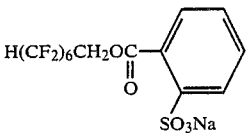

(I-19)

$C_{16}H_{33}-CH(SO_3Na)-CONH-CH_2CF_2-CHF_2$ (I-20)

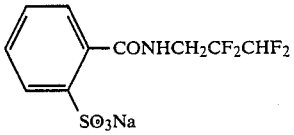

(I-21)

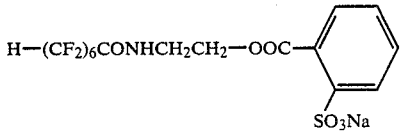

(I-22)

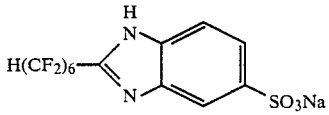

(I-23)

In the present invention, one or two or more compounds of the above compounds may be used in combination.

The amount of the compound represented by the formula (I) may be 0.5 to 500 mg (one surface) per 1 $m^2$ of the auxiliary layer of the light-sensitive silver halide photographic material, particularly preferably 0.5 to 100 mg (one surface).

The nonionic ethylene oxide compound preferably used in combination in the present invention is represented by the following formula (II):

$$R_1-L-(CH_2CH_2O)_m-H \qquad \text{Formula (II)}$$

wherein $R_1$ represents a substituted or unsubstituted alkyl group, alkenyl group or aryl group, L represents oxygen atom, sulfur atom, a —N—$R_2$ group, $-C(=O)-NR_2$ group or $-C(=O)-O-$, and $R_2$ represents hydrogen atom, a substituted or unsubstituted alkyl group or $-(CH_2CH_2O)_m-H$, and m represents an integer of 2 to 50.

In the following, specific examples of the compound represented by the formula (II) preferably used in the present invention are shown, but the present invention is not limited to these specific examples at all.

[Exemplary compounds]

$C_5H_{11}-O-(CH_2CH_2O)_5-H$ (II-1)
$C_8H_{17}-O-(CH_2CH_2O)_{10}-H$ (II-2)
$C_{12}H_{25}-O-(CH_2CH_2O)_8-H$ (II-3)
$C_{13}H_{27}-O-(CH_2CH_2O)_{10}-H$ (II-4)
$C_{16}H_{33}-O-(CH_2CH_2O)_{10}-H$ (II-5)
$C_{16}H_{37}-O-(CH_2CH_2O)_{15}-H$ (II-6)
$C_{13}H_{27}-O-(CH_2CH_2O)_{12}-H$ (II-7)
$CH_2ClCHClCH_2CH_2O-(CH_2CH_2O)_6-H$ (II-8)

-continued (II-9)

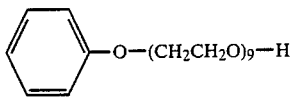

(II-10)

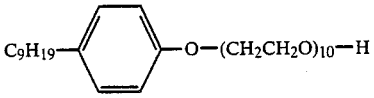

(II-11)

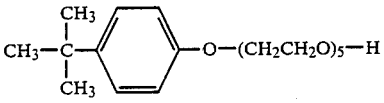

(II-12)

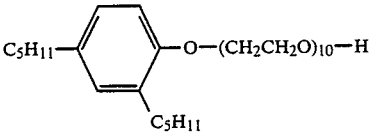

(II-13)

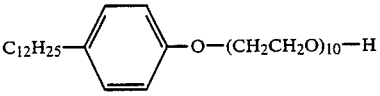

(II-14)

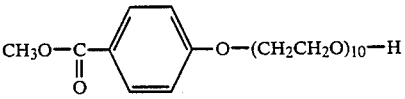

(II-15)

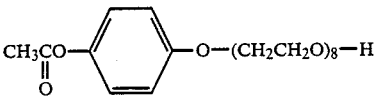

(II-16)

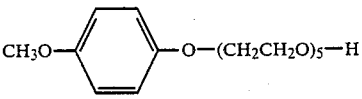

(II-17)

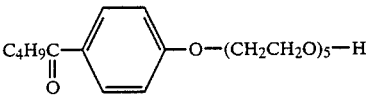

(II-18)

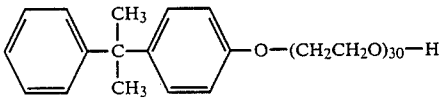

(II-19)

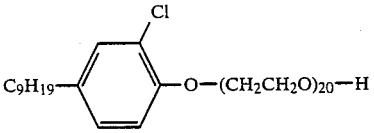

(II-20) $C_{12}H_{25}-S-(CH_2CH_2O)_{15}-H$ (II-21) $C_{16}H_{37}-S-(CH_2CH_2O)_{25}-H$ (II-22) $C_{10}H_{21}-S-(CH_2CH_2O)_{5}-H$ (II-23)

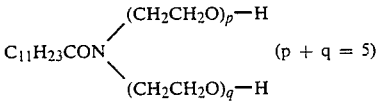

-continued (II-24)

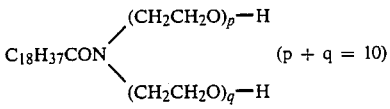

(II-25)

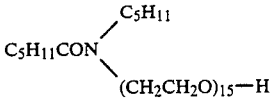

(II-26)

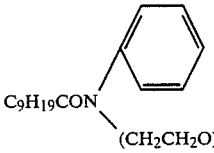

(II-27)

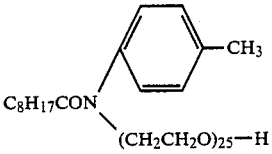

(II-28) $C_5H_{11}CONH-(CH_2CH_2O)_5-H$ (II-29)

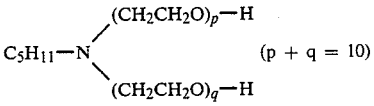

(II-30)

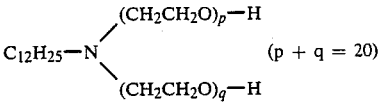

(II-31)

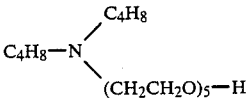

(II-32)

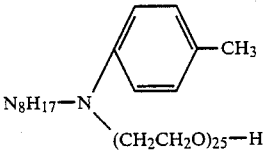

(II-33) $C_8H_{17}C(=O)-O-(CH_2CH_2O)_{10}-H$ (II-34) $C_{15}H_{31}C(=O)-O-(CH_2CH_2O)_{30}-H$ (II-35) $C_{10}H_{21}C(=O)-O-(CH_2CH_2O)_{10}-H$

In the present invention, the compound represented by the above formula (II) can be used either singly or as a combination of two or more kinds.

The amount of the compound represented by the above formula (II) used may be preferably 0.05 to 500 mg (one surface) per 1 $m^2$ of the auxiliary layer of the light-sensitive silver halide photographic material, more preferably 0.5 to 100 mg (one surface).

The compounds represented by the above formulae (I) and (II) may be dissolved in water; an organic solvent such as ethanol, acetone, etc.; a solvent mixture of water with the above organic solvent before incorporation in the auxiliary layer of the present invention.

The surface latent image type silver halide emulsion to be used in the present invention is an emulsion which, when developed after exposure for 1 to 1/100 sec. according to the method of surface development (A) and the method of internal development (B) as shown below, gives a sensitivity obtained by surface development (A) which is greater than that obtained by internal development (B), sensitivity of the former being preferably 2-fold or more than that of the latter. Here, sensitivity is defined as follows:

$$S=100/(Eh)$$

wherein S is sensitivity, Eh represents exposure dosage required for obtaining just the intermediate density $\frac{1}{2}(Dmax+Dmin)$ between the maximum density (Dmax) and the minimum density (Dmin).

[Surface development (A)]

Development is carried out in a developer with the recipe shown below at a temperature of 20° C. for 10 minutes.

| | |
|---|---|
| N—methyl-p-aminophenol (hemi-sulfate) | 2.5 g |
| Ascorbic acid | 10 g |
| Meta-sodium borate.tetrahydrate | 35 g |
| Potassium bromide | 1 g |
| Water added to | one liter |

[Internal development (B)]

Processing is conducted in a bleaching solution containing 3g/liter of red prussiate and 0.0126 g/liter of phenosafranine at 20° C. for 10 minutes, and then after washing with water for 10 minutes, development is carried out in a developer with the recipe shown below at 20° C. for 10 minutes.

| | |
|---|---|
| N—methyl-p-aminophenol (hemi-sulfate) | 2.5 g |
| Ascorbic acid | 10 g |
| Meta-sodium borate.tetrahydrate | 35 g |
| Potassium bromide | 1 g |
| Sodium thiosulfate | 3 g |
| Water added to | one liter |

As the surface latent image type silver halide emulsion, silver chloride, silver chlorobromide, silver bromide, silver chloroiodobromide, silver iodobromide may be employed, particularly preferably silver iodobromide or silver chloroiodobromide. The content of silver iodide in silver halide may be preferably 0.1 to 30 mol %, particularly 0.5 to 10 mol %.

The mean grain size of the surface latent image silver halide grains may be 0.1 to 5 μm, preferably 0.5 to 3 μm, to give good results.

In the present invention, the mean grain size refers to the grain diameter when the grain is spherical or approximate to spherical, or, in the case of a shape other than sphere, the mean grain size is the value based on the diameter when calculated on the circular image with the same area of its projected image.

Measurement of the mean grain size may be conducted by direct measurement from an electron microscope, by means of a Coulter counter or by means of a centrifuge system grain size distribution measuring instrument based on the principle of the liquid phase sedimentation method.

The surface latent type silver halide emulsion grains to be used may be in regular crystal forms such as cubic, octahedron, tetradecahedron, rhombic dodecahendron, or in irregular crystal forms such as spherical shape, potato shape, tabular shape, etc. Further, they may comprise a mixture of grains of various crystal forms.

Said surface latent image type silver halide emulsion may be mono-dispersed emulsion. Here, the mono-dispersed emulsion refers to one satisfying the following relationship:

$$\sigma/r \leqq 0.20$$

wherein r is the mean grain size of silver halide grains and $\sigma$ is the standard deviation thereof.

When AgBrI is used as the silver halide grains of the surface latent image type silver halide emulsion to be employed, the silver iodide distribution internally of the grains may be uniform, or higher toward the inner portion, or may be localized in the internal portion. When AgI is localized in the internal portion of the grains, the internal portion refers to the range up to $\frac{2}{3}$ of the total silver contained in the grains from the grain center.

The silver iodide distribution within grains of the silver halide grains can be determined by the method in which ion etching and X-ray photoelectric spectroscopy are combined.

The photographic emulsion of the present invention can be prepared according to any of the acidic method, the neutral method, the ammonia method, etc., and the reaction between a soluble silver salt and a soluble halide may be conducted according to any of the system of the one side mixing method, the simultaneous mixing method or a combination of them. Also, the method in which grains are formed under silver ion excess (the so-called reverse mixing method) may be used, and as one system of the simultaneous mixing method, the method in which pAg and pH in the liquid phase where silver halide is formed are controlled, namely the so-called controlled double jet method, can be also used.

For controlling grain growth of silver halide, various silver halide solvents can be used.

In the process of formation or physical aging of silver halide grains, cadmium salts, zinc salts, lead salts, thallium salts, iridium salts or complex salts thereof, rhodium salts or complex salts thereof, iron salts or complex salts thereof, etc. may be permitted to coexist.

The surface latent image type silver halide emulsion can be chemically sensitized according to various methods. Chemical sensitization may include, for example, sulfur sensitization, and gold sensitization, and these may be also used in combination.

The amount of the sulfur sensitizer added may vary within a considerable range depending on various conditions, but is generally about $1\times10^{-7}$ to $1\times10^{-2}$ per one mol of silver. The amount of the gold sensitizer added, which may also vary within a considerable range depending on various conditions, may be generally about $1\times10^{-9}$ to $1\times10^{-2}$ mol per one mol of silver.

On the other hand, in the sulfur-gold sensitization, the formulation ratio may vary depending on the aging conditions, but it is generally about 1 to 1000 moles per one mole of the gold sensitizer. Addition of the gold sensitizer may be at the same time as addition of the gold sensitizer, or during or after sulfur sensitization.

Although the conditions usch as pH, pAg, temperature, etc. during chemical sensitization are not particularly limited, pH value may be preferably maintained at 4 to 9, particularly 5 to 8, pAg value preferably at 5 to 11, particularly 8 to 10. The temperature may be preferably 40° to 90° C., particularly 45° to 75° C.

The photographic emulsion to be used in the present invention can be also used in combination with the reductive sensitization method by use of a reductive substance (e.g. stannous salt, amine salt, hydrazine derivative, formamidinesulfinic acid, silane compound), the noble metal sensitization method by use of a noble metal compound (e.g. complex salt of a metal of the group VIII of the periodic table such as Pt, Ir, Pd, etc. other than complex salt of gold), other than the sulfur sensitization, gold-sulfar sensitization as described above.

The photographic emulsion may be spectrally sensitized with methyne dyes and others.

The sensitizing dye may be used singly, but a combination of two or more kinds may be also used. Together with the sensitizing dye, a dye having itself no light sensitization action, or a color potentiating sensitizer which is a compound absorbing substantially no visible light but potentiating the sensitizing action of the sensitizing dye may be also contained in the emulsion.

The sensitizing dye to be used in the present invention is contained each at a ratio of $1\times10^{-6}$ to $5\times10^{-3}$ mol, preferably $1\times10^{-5}$ to $2.5\times10^{-3}$ mol, particularly $4\times10^{-5}$ mol to $1\times10^{-3}$ mol, per 1 mol of silver halide.

Next, as the silver halide emulsion having fogged nuclei internally of the grains in the present invention, there may be employed, for example, an emulsion with a transmitted fog density of 0.5 or less when a test strip with a coated silver amount of $2g/m^2$ without exposure is developed with D-19 (the developer designated by Eastman Kodak) at 35° C. for 2 minutes and a transmitted fog density of at least 1.0 when the same test strip without exposure is developed with a developer containing 0.5 g/liter of potassium iodide added in D-19 at 35° C. for 2 minutes.

The emulsion having fogged nuclei internally of grains can be prepared according to various known methods. For example, it can be obtained by preparing a core emulsion having fogged nuclei following the core-shell emulsion preparation method and then coating a shell emulsion around the core emulsion grains.

As the method for fogging core emulsion, there may be employed the method in which light is irradicated, the method in which the emulsion is fogged chemically with a reducing agent, an instable sulfur compound or a gold compound, the method in which the emulsion is aged at low pAg and high pH, etc. Among them, the method of using a reducing agent, the method of using a reducing agent and a gold compound in combination are preferred.

As the silver halide emulsion having fogged nuclei internally of grains, either one of silver chloride, silver chlorobromide, silver chloroiodobromide, silver bromide, silver iodobromide may be employed. Also, said silver halide grains may have regular crystal forms or irregular crystal forms.

The silver halide grain should preferably have a size (mean grain size) preferably of 0.1 to 0.7 μm, and a thickness of the shell portion preferably of 0.01 to 0.3 μm.

In the present invention, the mixing ratio (weight ratio) of the silver halide emulsion having fogged nuclei internally of grains to the surface latent image type emulsion may be preferably 1:100 to 100:1, more preferably 1:20 to 20:1.

As the binder or protective colloid in the photographic emulsion there may be preferably used gelatin such as lime gelating, acid-treated gelatin, derivative gelatin, gelatin-graft polymer, etc., but a hydrophilic colloid such as hydroxyethyl cellulose, polyvinyl alcohol, polyvinylimidazole, etc. can be used.

In the light-sensitive photographic material, for improvement of dimensional stability of the photographic emulsion layer and other hydrophilic colloid layers, a dispersing agent of a water-insoluble or difficultly soluble synthetic polymer can be contained. For example, there may be employed a polymer comprising monomer components of alkyl (meth)acrylate, alkoxyalkyl (meth-)acrylate, glycidyl (meth)acrylate, (meth)acrylamide, vinyl ester (e.g. vinyl acetate), acrylonitrile, olefin, styrene, etc., either alone or a combination, or a combination of these with acrylic acid, methacrylic acid, α,β-unsaturated dicarboxylic acid, hydroxyalkyl (meth)acrylate, sulfoalkyl (meth)acrylate, styrenesulfonic acid, etc.

In the present invention, for preventing fog and stabilizing photographic performance during the preparation steps, storage or photographic processing of the light-sensitive photographic material, various compounds can be contained. That is, azoles such as benzothiazolium salts, nitroindazoles, triazoles, benzotriazoles, benzimidazoles (particularly nitro- or halogen-derivatives); heterocyclic mercapto compounds such as mercaptothiazoles, mercaptobenzothiazoles, mercaptobenzimidazoles, mercaptothiadiazoles, mercaptotetrazoles (particularly 1-phenyl-5-mercaptotetrazole), mercaptopyrimidines; the above heterocyclic mercapto compounds having a water-soluble group such as carboxylic groups or sulfonic groups; thioketo compounds such as oxazolinethione; azaindenes such as tetraazaindenes (particularly 4-hydroxy-substituted (1,3,3a,7)tetraazaindenes); benzenethiosulfonic acids; benzenesulfinic acids; etc. can be contained.

Hereinbefore, other compounds which may be contained in the silver halide emulsion layer containing a surface latent type silver halide emulsion and a silver halide emulsion having fog internally of the grains will be described.

The antifoggant or stabilizer particularly preferably used in the present invention may include the compounds represented by the following formulea (III), (IV), (V), (VI) and nitrone compounds.

[III]

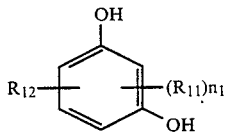

[IV]

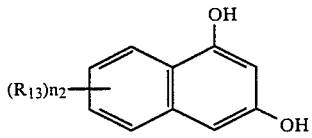

[V]

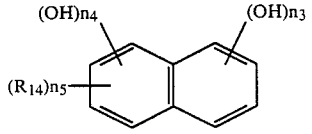

In the above formulae, $R_{11}$ represents hydrogen atom, a halogen atom, hydroxyl group, an alkyl group which may also have substituents, an aralkyl group which may also have substituents, an alkoxy group which may also have substituents, an acyl group which may also have substituents, a carboxymethyl group which may also have substituents, a —COOM group or a $—SO_3M$ group (M represents hydrogen atom, an alkali metal atom or ammonium group); $R_{12}$, $R_{13}$ and $R_{14}$ each represent a —COOM group or a $—SO_3M$ group: $n_1$ and $n_2$ each represent an integer of 1 to 3; $n_3$ represents 1 or 2; $n_4$ and $n_5$ each represent 0 or 1; with proviso that $n_3$ and $n_4$ cannot be both zero. When $n_1$ and $n_2$ are 2 or 3, $R_{11}$ and $R_{13}$ may be either the same or different.

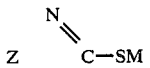

(VI)

In the above formula, Z represents an atomic group necessary for forming a 5- or 6-membered heterocyclic ring comprising carbon atom, nitrogen atom, oxygen atom, sulfur atom together with C=N.

The heterocyclic ring may be also bonded. Examples of these may include tetrozole ring, triozole ring, imidazole ring, thiadiazole ring, oxadiazole ring, oxazole ring, benzthiazole ring, benzimidazole ring, benzoxazole ring, purine ring, azaindene ring, tri-tetrapentapyridine ring, pyridine ring.

The heterocyclic rings may be also substituted with an alkyl group, an alkoxy group, an amino group, a halogen atom, a carbamoyl group, an alkylthio group, a mercapto group, etc. Among them, preferred are compounds in which Z forms tetrazole ring, triazole ring, thiadiazole ring, benzimidazole ring, benzthiazole ring together with C=N, and most preferred are compounds in which Z forms thiadiazole ring toghether with C=N. In the formula, M represents hydrogen atom, $—NH_4$ group or an alkali metal atom.

Specific examples of the compounds represented by the formula (III) which can be used in the present invention may include those as enumerated below.

III - (1)

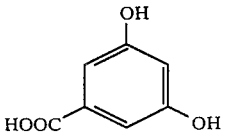

III - (2)

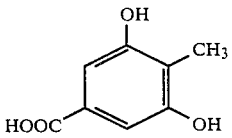

III - (3)

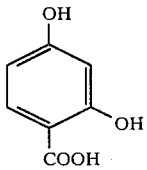

-continued

III - (4)

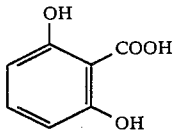

III - (5)

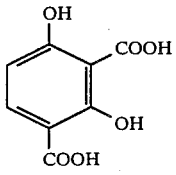

III - (6)

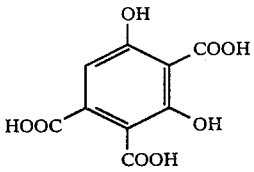

III - (7)

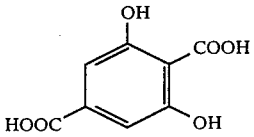

III - (8)

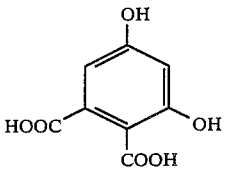

III - (9)

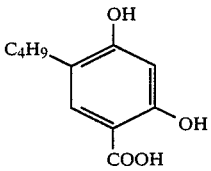

III - (10)

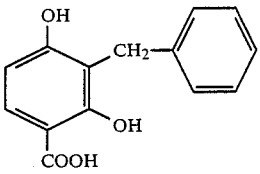

III - (11)

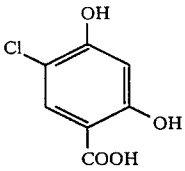

III - (12)

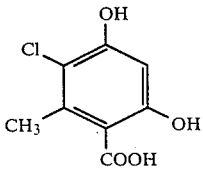

-continued
III - (13)
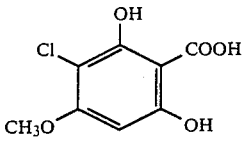
III - (14)
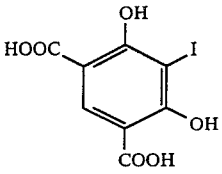
III - (15)
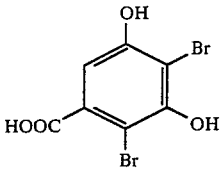
III - (16)
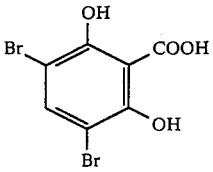
III - (17)
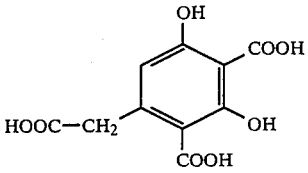
III - (18)
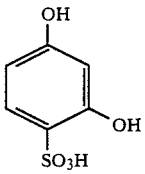
III - (19)
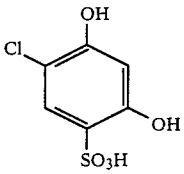
III - (20)
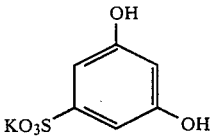
III - (21)
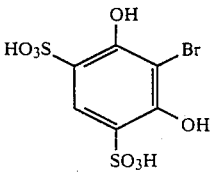
-continued
III - (22)
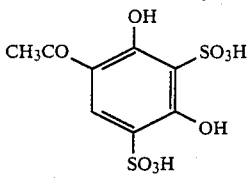
III - (23)
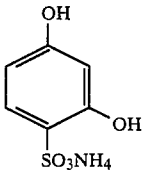
III - (24)
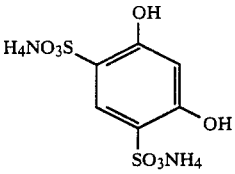
III - (25)
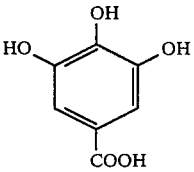
III - (26)
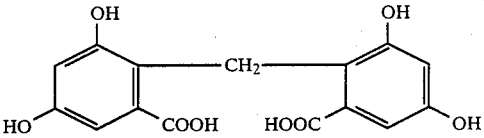
III - (27)
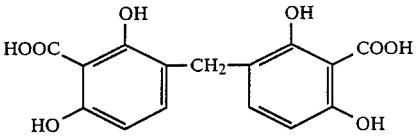
Specific examples of the compounds represented by the formula (IV) may include those shown below.
IV - (1)
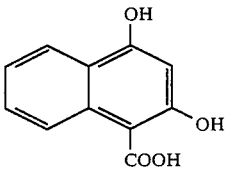
IV - (2)
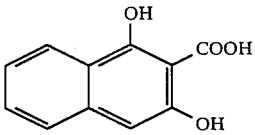
IV - (3)
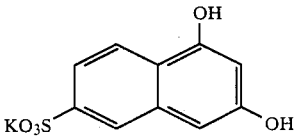

-continued
IV - (4)
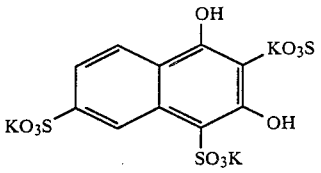
Specific examples of the compounds represented by the formula (V) may include those shown below.
V - (1)
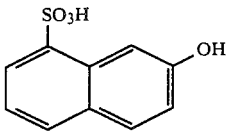
V - (2)
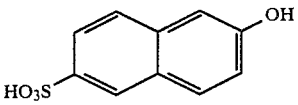
V - (3)
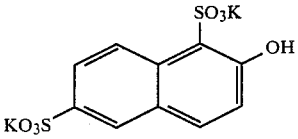
V - (4)
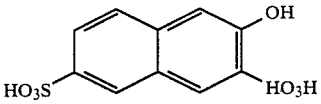
V - (5)
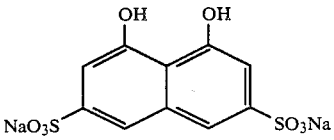
V - (6)
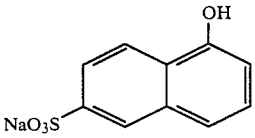
V - (7)
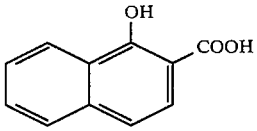
V - (8)
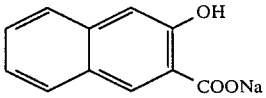
V - (9)
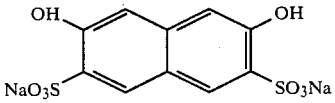
V - (10)
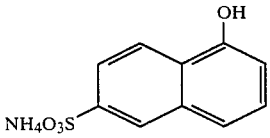
Preferable specific examples of the compounds represented by the formula (VI) may include those shown below.
VI - (1)
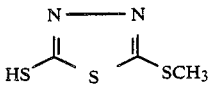
VI - (2)
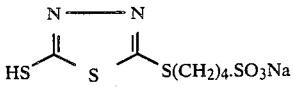
VI - (3)
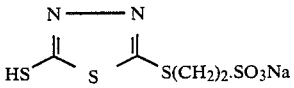
VI - (4)
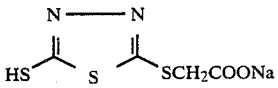
VI - (5)
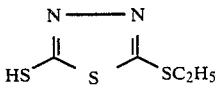
VI - (6)
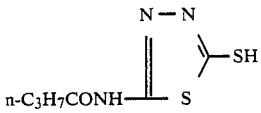
VI - (7)
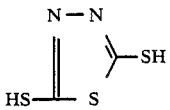
VI - (8)
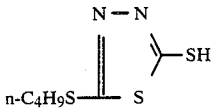
VI - (9)
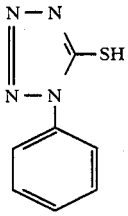
VI - (10)
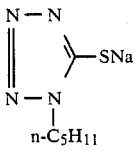
VI - (11)
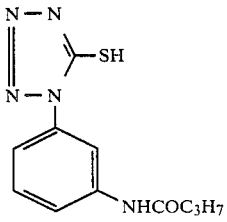

-continued

VI - (12)

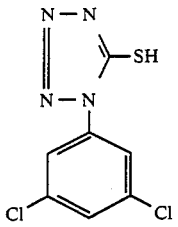

VI - (13)

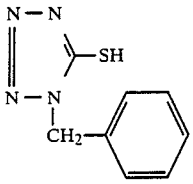

VI - (14)

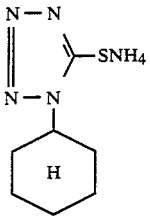

VI - (15)

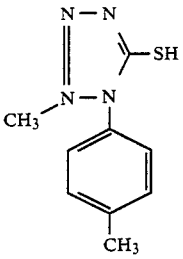

VI - (16)

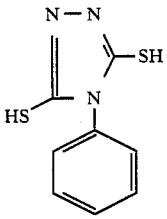

VI - (17)

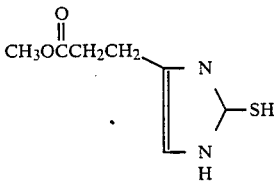

VI - (18)

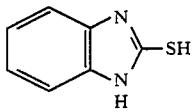

VI - (19)

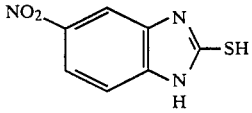

-continued

VI - (20)

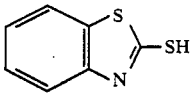

VI - (21)

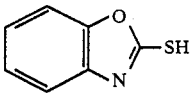

VI - (22)

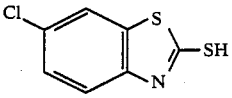

VI - (23)

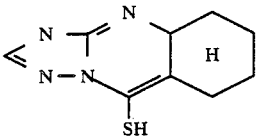

The compounds set forth above can be used preferably by addition in an amount of $5\times10^{-8}$ to $5\times10^{-3}$ mol per one mol of silver.

Next, the compounds represented by the following formula (VIIa) can be preferably used in the present invention as an antifoggant.

Formula (VIIa)

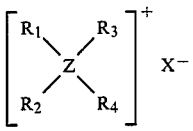

In the formula (VIIa), Z represents phosphorus atom or nitrogen atom, each of $R_1$, $R_2$, $R_3$ and $R_4$ represents a substituted or unsubstituted alkyl group, aryl group or aralkyl group. However, at least one of $R_1$, $R_2$, $R_3$ and $R_4$ is an aryl group or aralkyl group having an electron attractive substituent. $X^-$ represents an acid anion.

Among the compounds represented by the formula (VIIa) to be used in the present invention, the compounds which can be used particularly advantageously in the present invention are those represented by the following formula (VIIb).

Formula (VIIb)

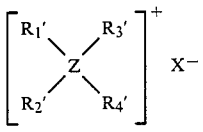

In the formula (VIIb), Z represents phosphorus atom or nitrogen atom, each of $R_{1'}$, $R_{2'}$, $R_{3'}$ and $R_{4'}$ represents a substituted or unsubstituted alkyl group having 1 to 6 carbon atoms, phenyl group, tolyl group, xylyl group, biphenyl group, naphthyl group anthryl group or

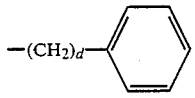

(d: an integer of 1 to 6).

Here, as the substituent, $-CH_3$, $-OH$, $-CN$, $-NO_2$, halogen atoms, carbonyl group, carboxyl group, sulfonyl group, quaternary amino group, etc. may be included and the number of substituents may be 1 to 2. However, at least one of $R_{1'}$, $R_{2'}$, $R_{3'}$ and $R'$ is an aryl group or aralkyl group having electron attractive substituent such as nitro group, cyano group, halogen atoms, carbonyl group, carboxyl group, sulfonyl group, quaternary amino group. $X^-$ represents an acid anion such as $Br^-$, $Cl^-$, $ClO_4^-$, $BF_4^-$.

The compounds represented by the above formula (VIIa) or (VIIb) can be synthesized by the method disclosed in U.S. Pat. No. 3,951,661.

Representative specific examples represented by the formula (VIIa) or (VIIb) particularly preferably used in the present invention are shown below.

Exemplary compounds:

[VII-1]

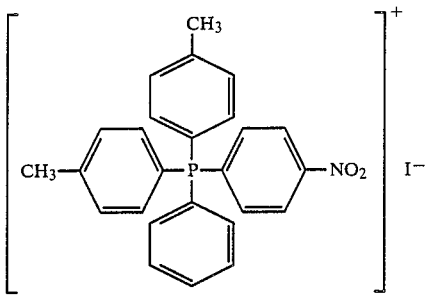

[VII-2]

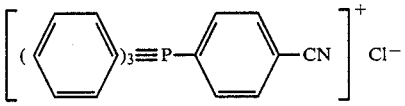

[VII-3]

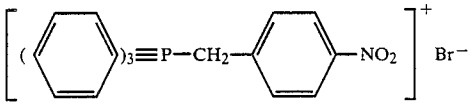

[VII-4]

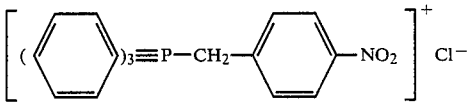

[VII-5]

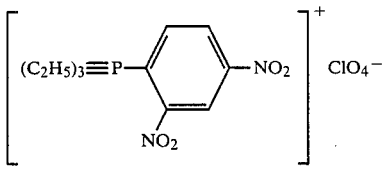

[VII-6]

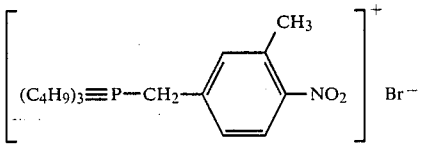

-continued

[VII-7]

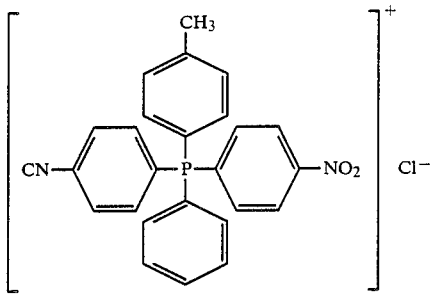

[VII-8]

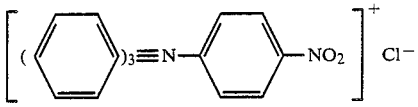

[VII-9]

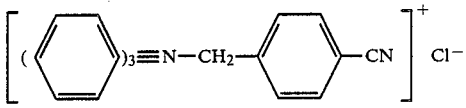

[VII-10]

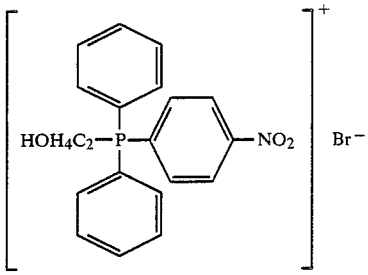

[VII-11]

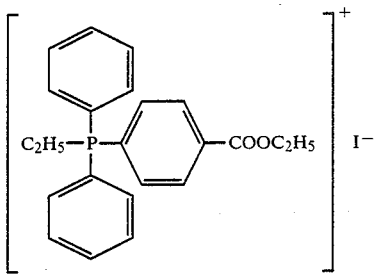

[VII-12]

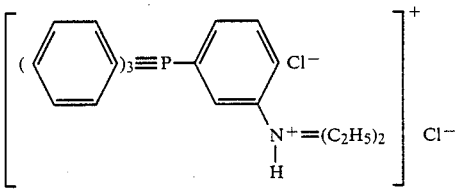

[VII-13]

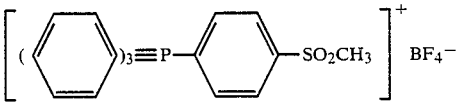

[VII-14]

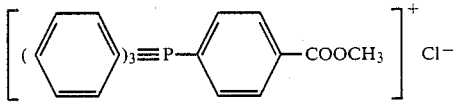

-continued

[VII-15]

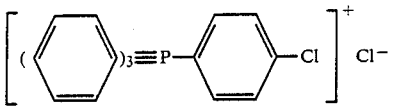

[VII-16]

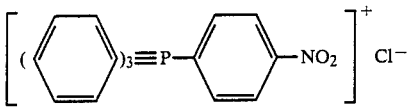

Also, nitrone compounds which can be used as the antifoggant or stabilizer may include various ones.

For example, it is possible to use the nitrone compounds or inorganic acid salts or organic acid salts of nitrone compounds represented by the following formula (VIII) or (IX) as disclosed in Journal of the Chemical Society, No. 1, p. 824–825 (1938), and specific examples may include, for example, hydrochloride, bromide, perchlorate, hydrosulfate or acetate of the above nitrone compound.

(VIII)

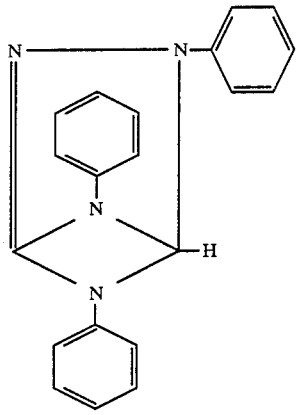

(IX)

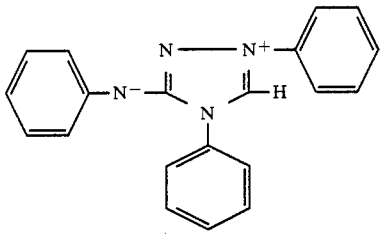

Otherwise, the following compounds shown in Japanese Unexamined Patent Publications Nos. 122936/1985 and 117240/1985 can be also used.

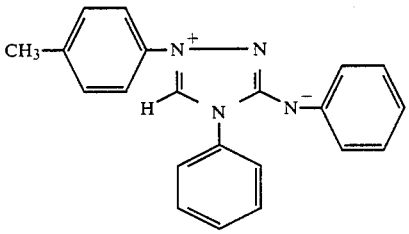

-continued

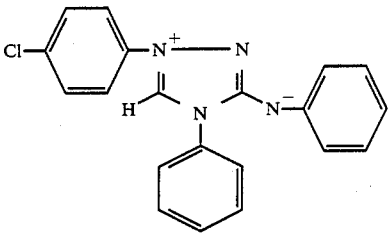

Further, the compounds represented by the following formula (B) can be also used as an antifoggant, stabilizer and processing stabilizer.

Formula (B)

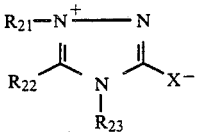

In the above formula, X represents sulfur atom or $=N-R_{24}$, each of $R_{21}$, $R_{22}$, $R_{23}$ and $R_{24}$ represents a substituted or unsubstituted alkyl group, aryl group or hetero ring. However, when $R_{24}$ is hydrogen atom, $R_{21}$ to $R_{23}$ represent groups other than hydrogen atom. Also, $R_{21}$ and $R_{22}$, $R_{22}$ and $R_{23}$, and $R_{23}$ and $R_{24}$ may be mutually bonded to form a ring. In the formula (B), the substituted or unsubstituted alkyl represents a substituted or unsubstituted straight alkyl group (e.g. methyl, ethyl, n-octyl group, etc.), a substituted or unsubstituted branched alkyl group (e.g. isopropyl, isobutyl, 2-ethylhexyl, t-butyl group, etc.), a substituted or unsubstituted cycloalkyl group (e.g. cyclopropyl, cyclopentyl, cyclohexyl group, etc.); the substituted or unsubstituted aryl group represents a substituted or unsubstituted phenyl group or naphthyl group, etc.; and the substituted or unsubstituted hetero ring represents a substituted or unsubstituted 3-pyridyl group, 2-furyl group, 2-benzothiazolyl group, etc.

Here, as the substituent on $R_{21}$, $R_{22}$, $R_{23}$ and $R_{24}$, there may be included halogen atoms, nitro group, cyano group, alkoxy group, carbamoyl group, sulfamoyl group, carboxy group, alkoxycarbonyl group, sulfo group, amide group, sulfonamide group, hydroxy group, sulfonyl group, sulfinyl group, sulfenyl group, mercapto group, amino group, ureido group, aminocarbonyloxy group, alkoxycarbonylamino group, aryl group, hetero ring, etc., and one or more substituents may be possessed.

Further, $R_{21}$ and $R_{22}$, $R_{22}$ and $R_{23}$, and $R_{23}$ and $R_{24}$ may be mutually bonded to form a ring such as a 5-membered or 6-membered ring.

Specific examples of the meso-ion triazolium compounds of the formula (B) are shown below, but the compounds available in the present invention are not limited to these specific examples.

B-(1)

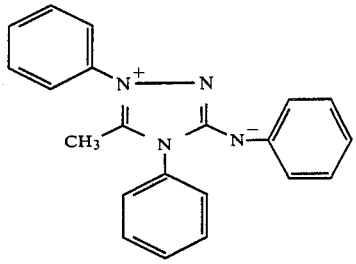

B-(2)

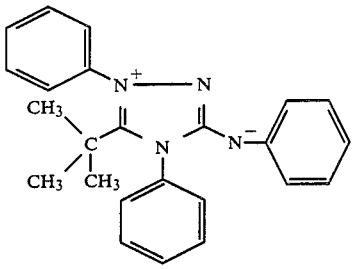

B-(3)

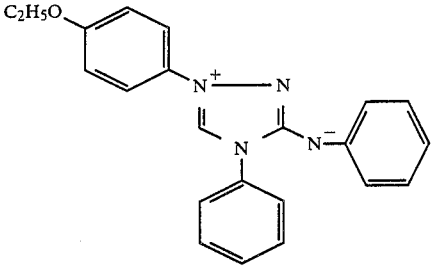

B-(4)

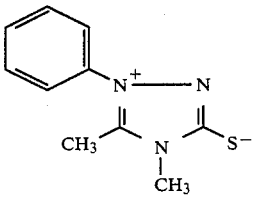

B-(5)

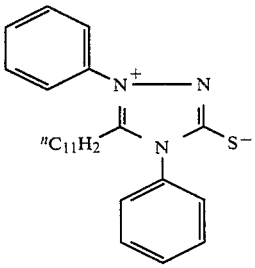

B-(6)

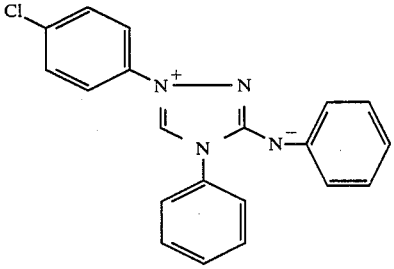

-continued

B-(7)

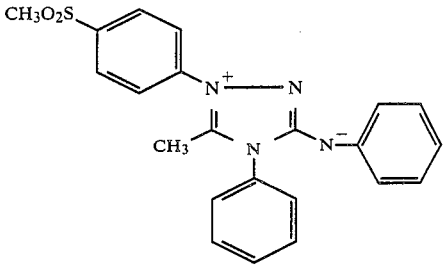

B-(8)

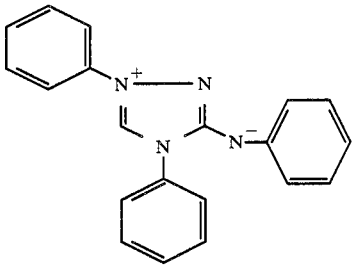

B-(9)

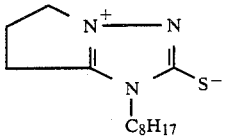

B-(10)

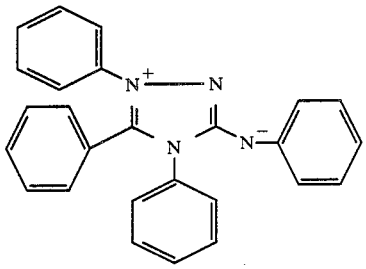

B-(11)

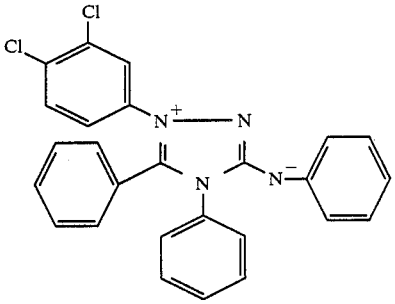

In the photographic emulsion to be used in the present invention, it is particularly preferable to incorporate a compound represented by the following formula (XIV) for inhibiting deterioration of image quality of photographic images in rapid development processing at high pH, high temperature, etc. and also improving graininess.

The amount added may be desirably 0.001 to 2 mg, preferably 0.01 to 1 mg per 1 g of the binder, as described in Japanese Unexamined Patent Publication No. 158631/1983.

Formula (XIV)

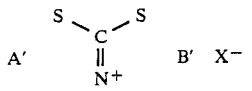

[In the above formula, each of A' and B' represents a group of non-metallic atoms necessary for formation of a hetero ring together with S and N; an X represents an anion (e.g. $Cl^-$, $Br^-$, $Cl^-$, $CH_3SO_3^-$, etc.)]

To describe in more detail about the formula (XIV), those wherein the group of non-metallic atoms A' and/or B' necessary for formation of the hetero ring of the compound represented by the formula (XIV) is represented by

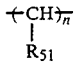

[where $R_{51}$ represents hydrogen atom or a lower alkyl group, and n represents 2 or 3] are desirable. Representative specific examples of the formula (XIV) may include the following compounds.

[XIV-1]

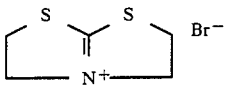

[XIV-2]

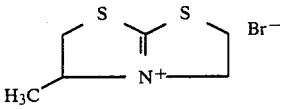

[XIV-3]

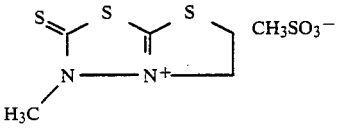

[XIV-4]

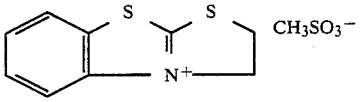

-continued

[XIV-5]

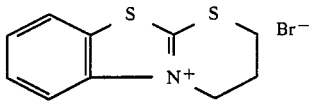

[XIV-6]

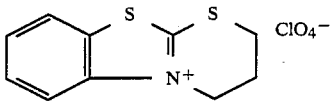

[XIV-7]

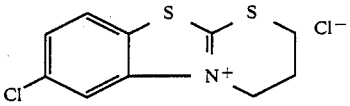

The sensitizer preferably used in the present invention is a compound represented by the formula (XV) shown below.

Formula (XV)

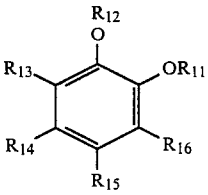

(In the formula, each of $R_{11}$ and $R_{12}$ represents hydrogen atom, or a substituted or unsubstituted alkyl group, alkenyl group, aryl group, acyl group or cycloalkyl group; each of $R_{13}$, $R_{14}$, $R_{15}$ and $R_{16}$ represents hydrogen atom, a halogen atom, hydroxy group or a substituted or unsubstituted alkyl group, alkenyl group, cycloalkyl group, aryl group, alkoxy group, acyl group, alkylthio group, aryloxy group, arylthio group, acylamino group, alkylamino group, alkoxycarbonyl group or sulfonamide group).

Specific examples of the compounds represented by said formula (XV) may include those shown below in Table A. That is, those corresponding to the groups of $R_{11}$ to $R_{16}$ in the above formula (XV) shown below in Table A may be included.

TABLE A

| No | $R_{11}$ | $R_{12}$ | $R_{13}$ | $R_{14}$ | $R_{15}$ | $R_{16}$ |
|---|---|---|---|---|---|---|
| 1 | —H | —H | —H | —H | —H | —H |
| 2 | —H | —H | $-CH_3$ | —H | —H | —H |
| 3 | —H | —H | $-C_2H_5$ | —H | —H | —H |
| 4 | —H | —H | $-OCH_3$ | —H | —H | —H |
| 5 | —H | —H | —Cl | —H | —H | —H |
| 6 | —H | —H | $-CH_2COOH$ | —H | —H | —H |
| 7 | —H | —H | 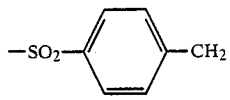 | —H | —H | —H |
| 8 | —H | —H | $-CH_2OH$ | —H | —H | —H |
| 9 | —H | —H | —H | $-CH_3$ | —H | —H |
| 10 | —H | —H | —H | $-NH_2$ | —H | —H |
| 11 | —H | —H | —H | $-C(CH_2)_3(t)$ | —H | —H |
| 12 | —H | —H | $-CH(CH_2)_3(t)$ | —H | $-CH_3$ | —H |
| 13 | $-CH_3$ | $-CH_3$ | —H | —H | —H | —H |

The inhibitor particularly preferably used in the present invention is a compound represented by the formula (XVI) shown below.

Formula (XVI)

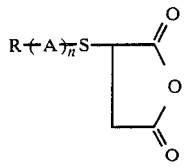

In the formula, R represents an aliphatic group, an aromatic group or a heterocyclic residue which may each have subsituent, n represents 0 or 1, and A represents —CO— or —$SO_2$—.

As the aliphatic group represented by the above R, there may be included alkyl groups having 1 to 18 carbon atoms (e.g. methyl, n-butyl, i-propyl, t-butyl, n-dodecyl group and the like), alkenyl groups (e.g. allyl, butynyl, octenyl group and the like), cycloalkyl groups (e.g. cyclopentyl, cyclohexyl group and the like). Said aliphatic group also includes aliphatic groups having 1 or more substituent (including substituting atom, hereinafter the same). Examples of these substituents may include alkoxy, aryl, aryloxy, amino, dialkylamino, heterocyclic groups (e.g. morpholino, N-morpholino, N-piperidino group), halogen atoms, nitro, hydroxy, carboxyl, sulfo, alkoxycarbonyl groups, etc. as representative ones.

The aromatic group represented by the above R may include preferably phenyl group and naphthyl group.

Said aromatic group is also inclusive of aromatic groups havng 1 or more substituents. Examples of these substituents may include alkyl, alkoxy, hydroxy groups, halogen atoms, acylamino, alkoxycarbonyl, succinimide, carbamoyl and nitro groups, etc. as representative ones.

The heterocyclic residue represented by R may include preferably a 5- or 6-membered heterocyclic ring having at least one of nitrogen atom, oxygen atom and sulfur atom (e.g. pyrrolyl, pyrrolidinyl, pyridyl, thiazolyl, morpholino, furanyl group, etc.). Said heterocyclic group may have substitutent, and examples of these substituents may be selected as desired from the above-mentioned substituents for the aliphatic groups and aromatic groups.

In the following, specific examples of the compounds represented by the formula (XVI) are enumerated.

(1)

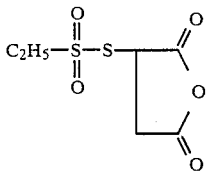

(2)

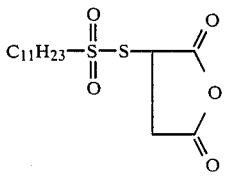

-continued (3)

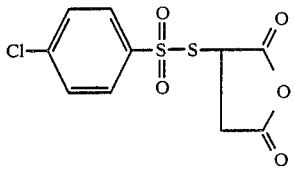

(4)

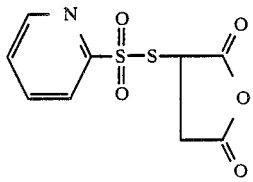

(5)

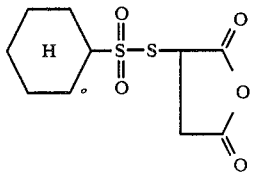

(6)

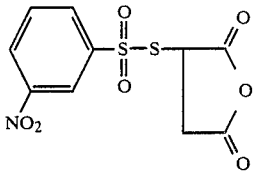

(7)

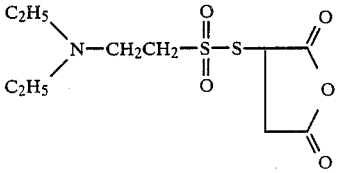

(8)

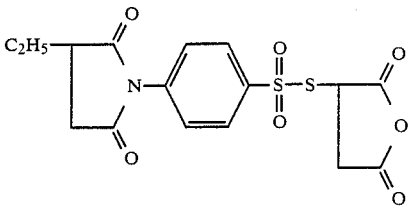

(9)

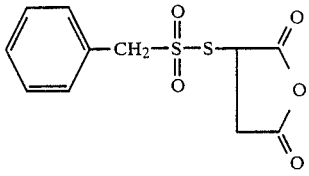

(10)

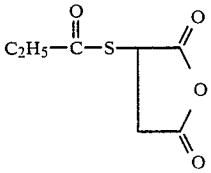

-continued (11)

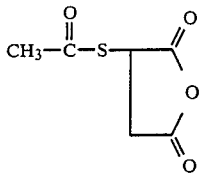

(12)

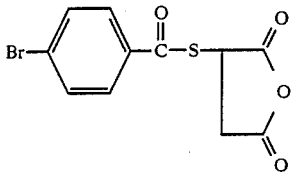

(13)

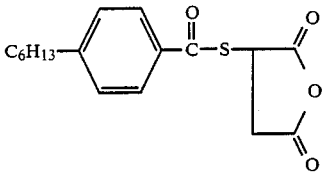

(14)

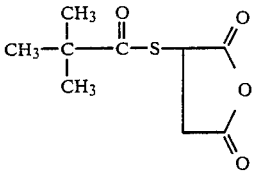

(15)

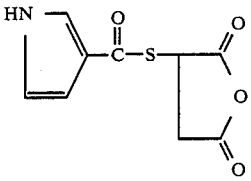

(16)

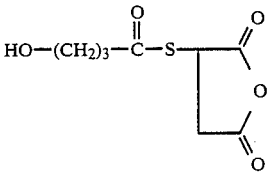

(17)

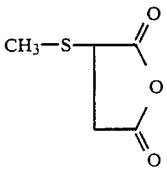

(18)

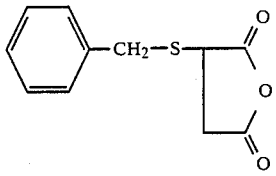

(19)

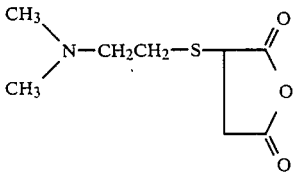

-continued (20)

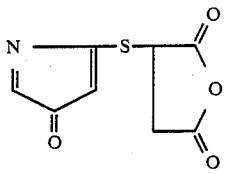

(21)

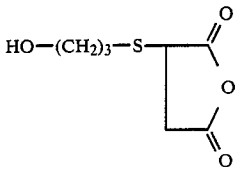

In the light-sensitive material of the present invention, the silver halide emulsion layer or other hydrophilic colloid layers can be hardened with a suitable film hardner.

For example, chromates (chromium alum, chromium acetate, etc.), aldehydes (formaldehyde, glyoxal, glutaraldehyde, etc.), N-methylol compounds (dimethylol urea, methylol dimethylhydantoin, etc.), dioxane derivatives (2,3-dihydroxydioxane, etc.), active vinyl comounds (1,3,5-triacryloyl-hexahydro-S-triazine, 1,3-vinylsulfonyl-2-propanol, etc.), active halides (2,4-dichloro-6-hydroxy-s-triazine, etc.), mucohalogenates (mucochloric acid, mucophenoxychloric acid, etc.), and so on can be used either alone or in combination.

The photographic emulsion layer of the present invention, for the purpose of sensitivity elevation, contrast elevation or development acceleraton, may also contain, for example, polyalkylene oxide or derivatives thereof such as ethers, esters, amines, etc., thioether compounds, thiomorpholine compounds, quaternary ammonium salt compounds, urethane derivatives, urea derivatives, imidazole derivatives, 3-pyrazolidones, etc.

Further, in the photographic emulsion layer or other hydrophilic colloid layers in the light-sensitive photographic material, there may be incorporated coating aids, and surfactants for prevention of charging, improvement of slippage, emulsification, prevention of adhesion and improvement of photographic characteristics (e.g. development acceleration, hard toning, sensitization), etc.

Concerning layer constitutions of the silver halide emulsion layers of the light-sensitive material of the present invention, there are several embodiments, representative of which are shown below:

(1) the constitution in which a surface latent image type silver halide emulsion and silver halide emulsion having fogged nuclei intermally of the grains are mixed and coated on a support;

(2) the constitution in which a silver halide emulsion layer having fogged nuclei internally of the grains is provided by coating on a support, and a layer containing a surface latent image type silver halide emulsion is further coated thereon;

(3) the constitution in which a layer containing a surface latent image type silver halide emulsion and a silver halide emulsion having fogged nuclei internally of the grains is provided by coating on a support, and an emulsion layer containing a surface latent image type silver halide emulsion is further coated thereon;

(4) the constitution in which a layer containing a surface latent image type silver halide emulsion and a silver halide emulsion having fogged nuclei internally of the grains is provided by coating on a support, and a layer containing a surface latent image type silver halide emulsion and a silver halide emulsion having fogged nuclei internally of the grains at a ratio different from that in the lower layer is further coated thereon; etc.

In the light-sensitive material of the present invention, the silver halide emulsion layer may be provided not only on one surface but also on both surfaces. In this case, the conditions of the present invention may be satisfied on at least one surface side, but preferably on both surface sides.

The light sensitive silver halide photographic material of the present invention can provide protective layer, antihalation layer, intermedite layer, filter layers, etc. constituting auxiliary layers thereon.

The protective layer in the light-sensitive material of the present invention is a layer comprising a hydrophilic colloid, and those as described above may be employed as the hydrophilic colloid. Also, the protective layer may be a single or double layer. In the protective layer, an antistatic agent may be also contained.

In the emulsion layer or the protective layer, at least one selected from matte agents, lubricating agents may be contained, but it is preferably contained in the protective layer. As the matte agent, those with particle sizes of 0.3 to 5 μm, or water-dispersible vinyl polymers (e.g. polymethyl methacrylate), silver halide, strontium barium sulfate, etc. with a thickness of 2-fold or more of the thickness of the protective layer may be employed.

The lubricating agent not only serves to prevent adhesion failure, but also is effective particularly for improvement of frictional characteristic related to camera adaptability during photographing of the film for movie or during projection thereof. As the lubricating agent, there may be employed fluid paraffins, waxes such as esters of higher fatty acids, polyfluorinated hydrocarbons or derivatives thereof, silicones such as polyalkylpolysiloxane, polyarylpolysiloxane, polyalkylarylpolysiloxane or alkylene oxide adduct derivatives thereof.

The light-sensitive silver halide photographic material of the present invention is applicable for X-ray light-sensitive materials, lith-light-sensitive materials, black-and-white photographing light-sensitive materials, color negative light-sensitive materials, color paper light-sensitive materials, etc.

The light-sensitive silver halide photographic material can incorporate dyes, fluorescent brighteners, color antifoggants, UV-ray absorbers, etc.

And, the photographic emulsion is applied on a flexible support such as plastic film, paper, cloth, etc. or a rigid support such as glass, porcelain, metal, according to dip coating, roller coating, curtain coating, extrusion coating, etc.

Flexible supports may include films comprising semi-synthetic or synthetic polymers such as cellulose nitrate, cellulose acetate, cellulose acetate butyrate, polystyrene, polyvinyl chloride, polyethylene terephthalate, polycarbonate, etc., papers coated or laminated with baryta layer or α-olefin polymer (e.g. polyethylene, polypropylene, ethylene/butene copolymer), etc.

In the photographic emulsion, a color image forming coupler may be contained. The color image forming coupler may be a non-diffusion type having a hydrophilic ballast group in the molecule. And, the color image forming coupler may be either diequivalent or tetraequivalent relative to silver ion. The color image forming coupler may be also one of which the product of the coupling reaction is colorless. Also, a colored coupler having the color correction effect, or a so-called DIR coupler releasing a development inhibitor or its precursor with development may be contained. Other than DIR coupler, a compound releasing a development inhibitor with development may be also contained in the light-sensitive material.

For photographic processing of the light-sensitive silver halide photographic material of the present invention, various methods are applicable by use of various processing liquors. The procesing temperature may be 18° C. to 50° C., but it may be also lower than 18° C. or higher than 50° C. For photographic processing, either monochromatic photographic processing or color photographic processing can be applied depending on the purpose.

In the case of monochromatic photographic processing, dihydroxybenzenes (e.g. hydroquinone), 3-pyrazolidones (e.g. 1-phenyl-3-pyrazolidone), aminophenols (e.g. N-methyl-p-aminophenol), 1-phenyl-3-pyrazolines, ascorbic acid, etc. can be contained singly or in combination in a developer. The developer contains otherwise a preservative, an alkali agent, a pH buffering agent, an anti-foggant (e.g. methylbenzotriazole, nitroindazole, etc.), etc. and further may optionally contain a dissolving aid, a tone agent, a development accelerator, a surfactant, a defoaming agent, a hard water softener, a film hardener, a tackifier, etc. The developer may have a pH preferably of 9 to 11, particularly 9.5 to 10.5.

The light-sensitive silver halide photographic material of the present invention is processed with a processing liquor containing a dialkylaldehyde type film hardener (e.g. glutaraldehyde, β-methylglutaraldehyde, succinic dialdehyde, etc.) (e.g. developing bath, its preceding bath, etc., containing about 1 to 20 g per one liter), as one of the preferred embodiments. Also, processing with a roller automatic developing machine may be possible.

As the fixing liquor, those with compositions generally used can be used.

As the fixing agent, there may be employed organic sulfur compounds of which the effect as the fixing agent has been known, other than thiosulfates, thiocyanates.

The fixing liquor may also contain a water-soluble aluminum salt as the film hardener.

The color developr comprises generally an alkaline aqueous solution containing a color developing agent. As the color developing agent, primary aromatic amine developing agents can be used, including, for eample, phenylenediamines (e.g. 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfoamidoethylaniline, 4-amino-3-methyl-N-ethyl-N-β-methoxyethylaniline and the like), etc.

The color developer can contain otherwise pH buffering agents, developing inhibitors or antifoggants. Also, if necessary, hard water softeners, preservatives, organic solvents, development accelerators, dye forming couplers, competitive couplers, fogging agens, auxiliary developing agents, tackifiers, etc. may be incorporated.

The photographic emulsion layer after color development is generally subjected to bleaching processing. Bleaching processing may be performed simultaneously with or separately from fixing processing. As the bleaching agent, potassium ferricyanate, iron (III) sodium ethylenediaminetetraacetate and iron (III) ammonium ethylenediaminetetraacetate are particularly useful. Ethylenediaminetetraacetic acid iron (III) complex is useful in both an independent bleaching solution and a one-bath bleach-fixing solution.

In the bleaching or bleach-fixing solution, various additives can be also added.

According to the present invention, there can be provided a light-sensitive silver halide photographic material improved in antistatic performance and improved in storability without accompaniment of lowering in sensitivity, which can give images with high sensitivity, high contrast as well as high covering power.

The present invention is described in more detail by referring to Examples, by which the present invention is not limited at all.

EXAMPLE 1

Preparation of a surface latent image type emulsion (Emulsion A)

A 1.6% aqueous gelatin solution containing 4.0 g of potassium iodide and 80 g of potassium bromide was maintained at 56° C. and an ammoniacal silver ion solution containing 100 g of silver nitrate was divided into three equal portions, and these were added respectively according to the single jet method and the normal mixing method. The mean grain size was controlled by varying the interval time at which these ammoniacal silver ions divided into three equal portions were added.

During addition of the ammoniacal silver ion solution, the second and the third additions were partially neutralized with acetic acid. And, after completion of the third addition, Ostwald aging was effected, and desalting effected by the precipitation method at pH 6 to obtain an emulsion of silver iodobromide grains shaped in irregular potato-like shapes with 4.0 mol% of silver iodide content. This emulsion had a mean grain size (r) of 1.1 μm and a $\sigma/r$ of 0.26.

Into this emulsion were added hypo, chloroauric acid and ammonium thiocyanate to effect gold-sulfur sensitization, followed by addition of 4-hydroxy-6-methyl-1,3,3a,7-tetrazaindene, to obtain an emulsion A.

Preparation of a silver halide emulsion having fogged nuclei internally of the grains (Emulsion I)

To a 2% gelatin solution maintained at 60° C. were added at the same time an aqueous silver nitrate solution and an aqueous halide solution containing potassium bromide and sodium chloride. After completion of addition, the temperature of the emulsion was lowered to 40° C. at which the desalting treatment was conducted, to obtain a silver chlorobromide emulsion with a mean grain size of 0.22 μm (ratio of Br to Cl=25:75).

The emulsion obtained was maintained at 60° C., and an aqueous thiourea dioxide solution and an aqueous choloauric acid solution were added to effect aging for 50 minutes, thereby forming fogged nuclei.

By controlling pH to 6.0 and pAg to 7.3, and further an aqueous silver nitrate solution and an aqueous solution containing potassium bromide and potassium iodide were added at the same time over 70 minutes. The desalting treatment was conducted to obtain an emulsion I having fogged nuclei internally of the grains with a mean grain size (r) of 0.35 μm and a $\sigma/r$ of 0.12.

Preparation of sample and test results

The silver halide emulsion (I) having fogged nuclei internally of grains and the surface latent image type silver halide emulsion A were mixed at a ratio of 1:4, and further each of the following compounds were added in the indicated amount per 1 mol of silver halide, and the resultant mixture was coated on a polyethylene terephthalate support.

| | | |
|---|---|---|
| 1. | Trimethylolpropane | 6 g |
| 2. | 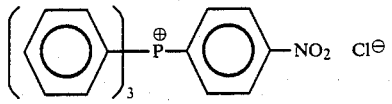 | 30 mg |
| 3. | 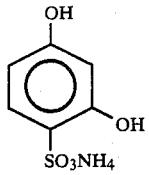 | 3 g |
| 4. | 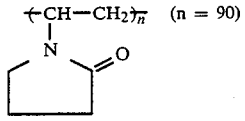 (n = 90) | 0.5 g |
| 5. | 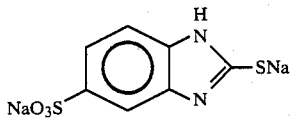 | 15 mg |
| 6. | 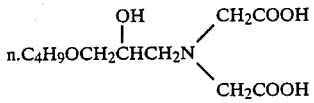 | 1 g |
| 7. | 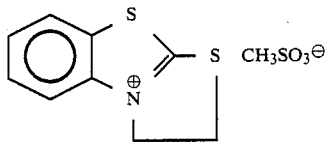 | 100 mg |
| 8. | t-Butylcatechol | 400 mg |
| 9. | 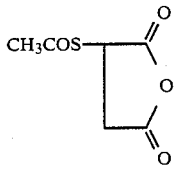 | 20 mg |
| 10. | 1,1-Dimethylol-1-bromo-1-nitromethane | 70 mg |
| 11. | 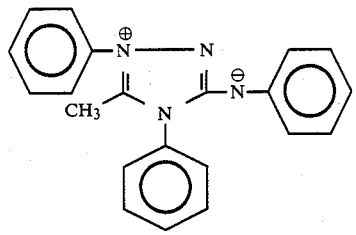 | 150 mg |

On the emulsion layer was added each of the following compounds in the amount indicated per 1 g of gelatin, and the solution added with the compounds represented by the formula (I) and/or (II) was coated to form a protective film.

| | | |
|---|---|---|
| a. | 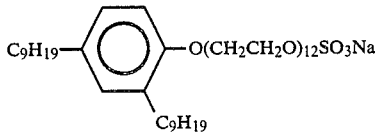 | 12 mg |
| b. | $CH_2COO(CH_2)_9CH_3$<br>\|<br>$CH_2COO(CH_2)_4CH_3$<br>\|<br>$SO_3Na$ | 7 mg |
| c. | 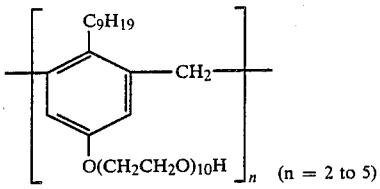 | 10 mg |
| d. | matte agent comprising polymethyl methacrylate with a mean particle size of 7 μm | 7 mg |
| e. | colloidal silica with a mean particle size of 0.013 μm | 70 mg |
| f. | formaldehyde | 3 mg |
| g. | glyoxal | 2 mg |

The amount of silver coated was 2.5 g/m$^2$ per one surface, with the gelatin amount in the protective film being 1.2 g/m$^2$.

These samples were stored under natural conditions and high temperature, high humidity conditions (50° C., 80RH %), and then these sample films were given standard exposure through an optical wedge at intervals of 0.15 density, and a high temperature rapid processing was conducted by use of the developer recipe shown below at 35° C. for 30 seconds by use of a continuous roller conveying system automatic developing machine which performs development, fixing and water washing steps in a series.

The density of the sample obtained was measured by a densitometer to obtain photographic characteristic values.

Antistatic characteristic was measured by rubbing with a rubber under the conditions of 23° C. and 25 RH % and then performing conventional development processing, and evaluation was made according to the situation of the static mark generated in five ranks as follows: A: "no generation", B: "small generation", C: "medium generation", D: "great generation. E: "maximum generation".

The surface specific resistance value was measured after humidity control of the sample strip under the conditions of 23° C. and 20RH % by use of a ultramicroammeter (MMA-VI-12 Model) produced by Kawaguchi Denki Co. and parallel electrodes made of a brass for one minute, and the equilibrated value of the indicated value was determined.

As the specific surface resistance value is smaller, electroconductivity is imparted, thus indicating good antistatic property.

(Developer recipe)

| | |
|---|---|
| Anhydrous sodium sulfite | 70 g |
| Ethylenediaminetetraacetic acid | 1.8 g |
| Hydroquinone | 10 g |
| Triethylene glycol | 29 g |
| Anhydrous boric acid | 1 g |
| Sodium carbonate.monohydrate | 20 g |
| 1-Phenyl-3-pyrazolidone | 0.35 g |
| Sodium hydroxide | 5 g |
| 5-Methyl-benzotriazole | 0.05 g |
| Potassium bromide | 5 g |
| Glutaraldehyde bisulfite | 15 g |
| Glacial acetic acid | 8 g |
| (made up to one liter with addition of water) | |

(Fixing solution recipe)

| | |
|---|---|
| Ammonium thiosulfate | 200 g |
| Anhydrous sodium sulfite | 20 g |
| Disodium ethylenediaminetetraacetate | 0.2 g |
| Boric acid | 8 g |
| Aluminum sulfate | 15 g |
| Sulfuric acid | 2 g |
| Acetic acid | 22 g |
| (made up to one liter with addition of water) | |

The results are shown in Table 1.

The sensitivity value in the Table was represented in a relative value to the value of Sample No. 1 which is made 100.

TABLE 1

| | | | 3 days storing under natural conditions | | | | | | 50° C. 80 RH % | | | | |
|---|---|---|---|---|---|---|---|---|---|---|---|---|---|
| No. | Compounds of Formula (I) | Compounds of Formula (II) | Surface Specific resistance Ω | Static mark | Fog-ging | Sensi-tivity | γ | Dmax | Fog-ging | Sensi-tivity | γ | Dmax | Re-marks |
| 1 | — | — | $1 \times 10^{14}$ | E | 0.04 | 100 | 3.30 | 3.42 | 0.18 | 52 | 3.10 | 3.40 | Com-par-ative |
| 2 | | II-3 30 mg/m$^2$ | $1.6 \times 10^{12}$ | C | 0.04 | 108 | 3.43 | 3.48 | 0.17 | 56 | 3.36 | 3.46 | |
| 3 | | II-4 30 mg/m$^2$ | $2.0 \times 10^{12}$ | C | 0.04 | 110 | 3.45 | 3.49 | 0.18 | 58 | 3.32 | 3.47 | |
| 4 | | II-7 30 mg/m$^2$ | $9.8 \times 10^{11}$ | B | 0.04 | 109 | 3.48 | 3.50 | 0.18 | 56 | 3.34 | 3.45 | |
| 5 | | II-10 30 mg/m$^2$ | $1.7 \times 10^{12}$ | C | 0.04 | 112 | 3.48 | 3.49 | 0.19 | 60 | 3.35 | 3.44 | |
| 6 | | II-17 30 mg/m$^2$ | $9.0 \times 10^{11}$ | B | 0.04 | 107 | 3.42 | 3.47 | 0.17 | 57 | 3.36 | 3.45 | |
| 7 | | II-20 30 mg/m$^2$ | $2.3 \times 10^{12}$ | B | 0.04 | 110 | 3.47 | 3.48 | 0.18 | 59 | 3.34 | 3.43 | |
| 8 | | II-23 30 mg/m$^2$ | $8.5 \times 10^{11}$ | C | 0.04 | 115 | 3.50 | 3.50 | 0.19 | 60 | 3.30 | 3.48 | |
| 9 | | II-28 30 mg/m$^2$ | $1.0 \times 10^{12}$ | B | 0.04 | 108 | 3.44 | 3.47 | 0.19 | 58 | 3.31 | 3.45 | |
| 10 | I-1 30 mg/m$^2$ | | $4.5 \times 10^{11}$ | B | 0.04 | 106 | 3.42 | 3.48 | 0.05 | 103 | 3.42 | 3.46 | This inven-tion |
| 11 | I-2 30 mg/m$^2$ | | $3.1 \times 10^{11}$ | A | 0.03 | 108 | 3.46 | 3.50 | 0.04 | 106 | 3.45 | 3.50 | |
| 12 | I-3 30 mg/m$^2$ | | $2.7 \times 10^{11}$ | A | 0.04 | 112 | 3.52 | 3.50 | 0.04 | 108 | 3.50 | 3.50 | |
| 13 | I-4 30 mg/m$^2$ | | $4.0 \times 10^{11}$ | B | 0.04 | 109 | 3.48 | 3.49 | 0.05 | 105 | 3.46 | 3.47 | |
| 14 | I-5 30 mg/m$^2$ | | $2.1 \times 10^{11}$ | A | 0.03 | 116 | 3.52 | 3.51 | 0.04 | 110 | 3.50 | 3.50 | |
| 15 | I-6 30 mg/m$^2$ | | $3.5 \times 10^{11}$ | A | 0.04 | 105 | 3.42 | 3.47 | 0.04 | 100 | 3.42 | 3.45 | |
| 16 | I-7 30 mg/m$^2$ | | $2.6 \times 10^{11}$ | A | 0.04 | 110 | 3.49 | 3.48 | 0.04 | 103 | 3.48 | 3.46 | |
| 17 | I-10 30 mg/m$^2$ | | $2.4 \times 10^{11}$ | A | 0.03 | 112 | 3.51 | 3.50 | 0.03 | 108 | 3.50 | 3.50 | |

TABLE 1-continued

| No. | Compounds of Formula (I) | Compounds of Formula (II) | 3 days storing under natural conditions: Surface Specific resistance Ω | Static mark | Fog-ging | Sensi-tivity | γ | Dmax | 50° C. 80 RH %: Fog-ging | Sensi-tivity | γ | Dmax | Re-marks |
|---|---|---|---|---|---|---|---|---|---|---|---|---|---|
| 18 | I-12 30 mg/m$^2$ | | $3.8 \times 10^{11}$ | B | 0.04 | 106 | 3.43 | 3.47 | 0.05 | 103 | 3.43 | 3.45 | |
| 19 | I-15 30 mg/m$^2$ | | $4.2 \times 10^{11}$ | B | 0.04 | 107 | 3.46 | 3.48 | 0.04 | 105 | 3.41 | 3.45 | |
| 20 | I-21 30 mg/m$^2$ | | $3.1 \times 10^{11}$ | A | 0.04 | 115 | 3.50 | 3.51 | 0.04 | 110 | 3.50 | 3.50 | |
| 21 | I-5 20 mg/m$^2$ | II-4 10 mg/m$^2$ | $1.2 \times 10^{11}$ | A | 0.04 | 125 | 3.52 | 3.50 | 0.04 | 120 | 3.51 | 3.50 | |
| 22 | I-5 20 mg/m$^2$ | II-7 10 mg/m$^2$ | $1.4 \times 10^{11}$ | A | 0.03 | 120 | 3.51 | 3.51 | 0.03 | 117 | 3.50 | 3.50 | |
| 23 | I-5 20 mg/m$^2$ | II-10 10 mg/m$^2$ | $1.1 \times 10^{11}$ | A | 0.04 | 122 | 3.52 | 3.50 | 0.04 | 119 | 3.52 | 3.49 | |
| 24 | I-5 20 mg/m$^2$ | II-17 10 mg/m$^2$ | $1.3 \times 10^{11}$ | A | 0.04 | 121 | 3.53 | 3.52 | 0.04 | 120 | 3.51 | 3.52 | |
| 25 | I-1 20 mg/m$^2$ | II-7 10 mg/m$^2$ | $2.1 \times 10^{11}$ | A | 0.04 | 120 | 3.45 | 3.49 | 0.04 | 118 | 3.42 | 3.48 | |
| 26 | I-2 20 mg/m$^2$ | II-7 10 mg/m$^2$ | $2.0 \times 10^{11}$ | A | 0.03 | 122 | 3.46 | 3.50 | 0.03 | 119 | 3.42 | 3.50 | This inven-tion |
| 27 | I-3 20 mg/m$^2$ | II-7 10 mg/m$^2$ | $1.7 \times 10^{11}$ | A | 0.04 | 126 | 3.53 | 3.51 | 0.04 | 123 | 3.50 | 3.51 | |
| 28 | I-4 20 mg/m$^2$ | II-7 10 mg/m$^2$ | $1.8 \times 10^{11}$ | A | 0.04 | 128 | 3.50 | 3.49 | 0.04 | 126 | 3.50 | 3.48 | |
| 29 | I-6 30 mg/m$^2$ | II-7 10 mg/m$^2$ | $2.0 \times 10^{11}$ | A | 0.04 | 120 | 3.48 | 3.50 | 0.04 | 120 | 3.46 | 3.49 | |
| 30 | I-7 20 mg/m$^2$ | II-10 10 mg/m$^2$ | $2.1 \times 10^{11}$ | A | 0.04 | 124 | 3.49 | 3.51 | 0.04 | 122 | 3.47 | 3.48 | |
| 31 | I-10 20 mg/m$^2$ | II-17 10 mg/m$^2$ | $1.9 \times 10^{11}$ | A | 0.04 | 125 | 3.50 | 3.51 | 0.04 | 122 | 3.50 | 3.51 | |
| 32 | I-12 20 mg/m$^2$ | II-10 10 mg/m$^2$ | $1.7 \times 10^{11}$ | A | 0.04 | 124 | 3.48 | 3.49 | 0.04 | 121 | 3.48 | 3.47 | |
| 33 | I-15 20 mg/m$^2$ | II-17 10 mg/m$^2$ | $1.4 \times 10^{11}$ | A | 0.04 | 120 | 3.47 | 3.50 | 0.04 | 116 | 3.46 | 3.50 | |

As is apparent from Table 1, when the compound represented by the formula (I) is used, antistatic characteristic and storability under high temperature, high humidity conditions can be improved. Further, when the compound represented by the formula (II) is used in combination, it can be understood that further excellent antistatic characteristic, sensitivity and storability can be improved.

EXAMPLE 2

The coating solution was made entirely the same as in Exmple 1, except for using a sensitizing dye having the absorption peak in the green-light region during preparation of the emulsion coating solution. Correspondingly, sensitometry was effected also with a green-light having the intensity peak at 550 nm, to obtain the same results as in Example 1.

We claim:

1. A light-sensitive silver halide photographic material comprising at least one silver halide emulsion layer on at least one side of a support and at least one auxiliary layer adjacent to aid silver halide emulsion layer, said silver halide emulsion layer containing a surface latent type silver halide emulsion and a silver halide emulsion having fog internally of the grains, and said auxiliary layer containing compounds represented by formula (I) and formula (II) shown below:

$RfSO_3M$ Formula (I)

wherein Rf is a substituted or unsubstituted alkyl group or a substituted or unsubstituted aralkyl group, containing at least 3 fluorine atoms, and M represents hydrogen atom, an alkali metal or ammonium group;

$R_1—L—(CH_2CH_2O)_m—H$ Formula (II)

wherein $R_1$ is a substituted or unsubstituted alkyl group, alkenyl group or aryl group, L represents oxygen atom, sulfur atom, a -N-$R_2$ group $$-\underset{\underset{O}{\|}}{C}-NR_2 \text{ group or } -\underset{\underset{O}{\|}}{C}-O-,$$

and $R_2$ represents hydrogen atom, an alkyl group or $—(CH_2CH_2O)_m—H$, and m represents an integer of 2 to 50.

2. The light-sensitive silver halide photographic material according to claim 1, wherein the amount of the compound represented by the formula (I)is 0.05 to 500 mg per 1 m$^2$ of the auxiliary layer on one surface of the light-sensitive silver halide photographic material.

3. The light-sensitive silver halide photographic material according to claim 1, wherein the amount of the compound represented by the formula (II) is 0.05 to 500 mg per 1 m$^2$ of the auxiliary layer on one surface of the light-sensitive silver halide photographic material.

4. The light-sensitive silver halide photographic material according to claim 1, wherein the mixing ratio of the silver halide emulsion having fogged nuclei internally of grains to the surface latent image type emulsion is 1:100 to 100:1 by weight ratio.

5. The light-sensitive silver halide photographic material according to claim 1, wherein the silver halide emulsion layer contains at least one compound selected from the group consisting of the compounds represented by formulae (III), (IV), (V) and (VI) and nitrone compounds:

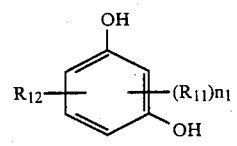

Formula (III)

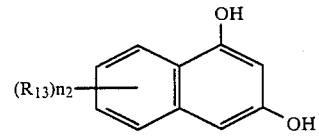

Formula (IV)

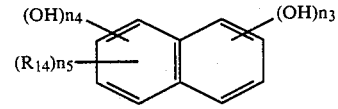

Formula (V)

wherein, $R_{11}$ represents hydrogen atom, a halogen atom, hydroxyl group, a substituted or unsubstituted alkyl group, aralkyl group, alkoxy group, acyl group, carboxymethyl group or —COOM group or a $—SO_3M$ group; where M represents hydrogen atom, an alkali metal atom or ammonium group; $R_{12}$, $R_{13}$ and $R_{14}$ each represent a —COOM group or a —$SO_3M$ group; $n_1$ and $n_2$ each represent an integer of 1 to 3; $n_3$ represents 1 or 2; $n_4$ and $n_5$ each represent 0 or 1; with proviso that $n_3$ and $n_4$ cannot be both zero, and when $n_1$ and $n_2$ are 2 or 3, $R_{11}$ and $R_{13}$ may be either the same or different, Formula (VI)

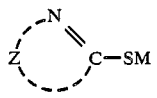

wherein, Z represents an atomic group necessary for forming a 5- or 6-membered heterocyclic ring comprising carbon atom, nitrogen atom, oxygen atom, sulfur atom together with C=N.

6. The light-sensitive silver halide photographic material according to claim 5, wherein the nitrone compounds is nitrone compounds represented by the following formula (VIII) or (IX) or inorganic acid salts or organic acid salts thereof:

Formula (VIII)

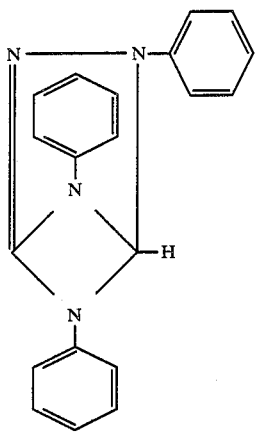

Formula (IX)

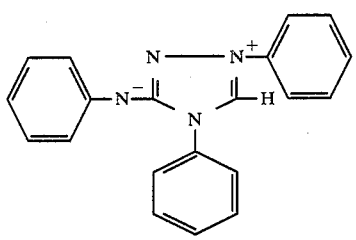

7. The light-sensitive silver halide photographic material according to claim 1, wherein the silver halide emulsion layer contains a compound represented by Formula (B):

Formula (B)

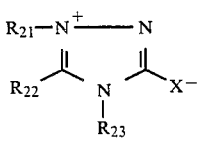

wherein, X represents sulfur atom or =N—$R_{24}$; each of $R_{21}$, $R_{22}$, $R_{23}$ and $R_{24}$ represents a substituted or unsubstituted alkyl group, aryl group or hetero ring; with proviso that, when $R_{24}$ is hydrogen atom, $R_{21}$, $R_{22}$ and $R_{23}$ represent groups other than hydrogen atom; and $R_{21}$ and $R_{22}$, $R_{22}$ and $R_{23}$, and $R_{23}$ and $R_{24}$ may be mutually bonded to form a ring.

8. The light-sensitive silver halide photographic material according to claim 1, wherein the silver halide emulsion layer contains a compound represented by the following fomula (XIV):

Formula (XIV)

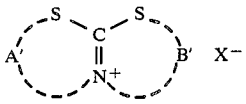

wherein, each of A' and B' represents a group of non-metallic atoms necessary for formation of a hetero ring together with S and N; and X represents an anion.

9. The light-sensitive silver halide photographic material according to claim 1, wherein the silver halide emulsion layer contains a sensitizer represented by Formula (XV):

Formula (XV)

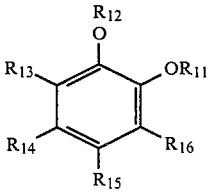

wherein, each of $R_{11}$ and $R_{12}$ represents hydrogen atom, or a substituted or unsubstituted alkyl group, alkenyl group; aryl group, acyl group or cycloalkyl group; each of $R_{13}$, $R_{14}$, $R_{15}$ and $R_{16}$ represents hydrogen atom, a halogen atom, hydroxy group or a substituted or unsubstituted alkyl group, alkenyl group, cycloalkyl group, aryl group, alkoxy group, acyl group, alkylthio group, aryloxy group, arylthio group, acylamino group, alkylamino group, alkoxycarbonyl group or sulfonamide group.

10. The light-sensitive silver halide photographic material of claim 1 wherein Rf is said substituted alkyl group containing at least 3 fluorine atoms.

11. The light-sensitive sliver halid photographic material of claim 10 wherein the compound of formula (I) is (I-3)

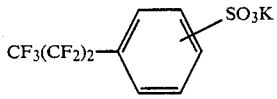

wherein —$SO_3K$ is attached on o-, m- or p-position; or (I-4)

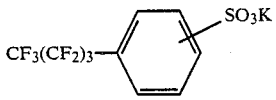

wherein —$SO_3K$ is attached on o-, m- or p-position.

12. The light-sensitive silver halide photographic material of claim 10 wherein the compound of formula (I) is $CF_3(CF_2)_7SO_3K$ 13. The light-sensitive silver halide photographic material of claim 10 wherein the compound of formula (I) is
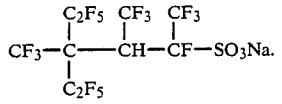
* * * * *